United States Patent [19]

Kisakibaru et al.

[11] Patent Number: 4,947,088

[45] Date of Patent: Aug. 7, 1990

[54] METHOD AND APPARATUS FOR CONTROLLING REEL TENSION

[75] Inventors: Toshiro Kisakibaru; Tsuguo Gotoh, both of Tokyo; Kazunori Ohuchi, both of Fukuoka, all of Japan

[73] Assignee: Yaskawa Electric Mfg. Co., Ltd., Kitakyushu, Japan

[21] Appl. No.: 143,807

[22] Filed: Jan. 14, 1988

Related U.S. Application Data

[63] Continuation of Ser. No. 776,971, Sep. 12, 1985, Pat. No. 4,720,661.

[30] Foreign Application Priority Data

Jan. 14, 1984 [JP] Japan ..... 59-4274

[51] Int. Cl.[5] ..... H02P 7/06; B65H 59/38

[52] U.S. Cl. ..... 318/6; 242/75.51; 364/473

[58] Field of Search ..... 318/6, 7; 242/67.5, 242/75.44, 75.45, 75.46, 75.51, 84.1 R; 364/469, 473

[56] References Cited

U.S. PATENT DOCUMENTS

| | | | |
|---|---|---|---|
| 3,814,310 | 6/1974 | Safiuddin et al. | 318/6 X |
| 4,363,457 | 12/1982 | Flint et al. | 318/7 X |
| 4,519,039 | 5/1985 | Surana et al. | 318/7 X |
| 4,532,597 | 7/1985 | Safiuddin et al. | 318/7 X |
| 4,720,661 | 1/1988 | Kisakibara et al. | 318/6 |

FOREIGN PATENT DOCUMENTS

| | | | |
|---|---|---|---|
| 56-17851 | 2/1981 | Japan | 242/75.51 |
| 57-72549 | 5/1982 | Japan | 242/75.44 |
| 57-80288 | 5/1982 | Japan | 318/6 |
| 59-149260 | 8/1984 | Japan | 242/75.44 |

*Primary Examiner*—Bentsu Ro

*Attorney, Agent, or Firm*—Schmeiser, Morelle & Watts

[57] ABSTRACT

Hitherto, in the tension control for a reel, it is impossible to exceed the tension controlling range of about 1:10 which is determined by the tension controlling range of a single DC motor, so that for the reel which requires a tension controlling range over 1:10, a plurality of DC motors have been combined and used or a gear ratio between the reel and the DC motor has been changed for many years so far.

In this invention an attention is paid to the fact such that the unpreferable phenomena such as a change in characteristic due to an armature reaction, and deterioration of rectification or the like which are caused by setting the field system to a low level can be fairly suppressed by limiting the setting and controlling range to a low region of an armature current. The field system is set to a low level so that a ratio of a field magnetic flux to a diameter of a coil becomes a value lower than the maximum value and also the upper limit of an operating armature current which is practically applied is set to be low, thereby making it possible to perform the stable tension control within a low tension range which could not be realized so far by a single DC motor.

18 Claims, 2 Drawing Sheets

FIG. 2 PRIOR ART
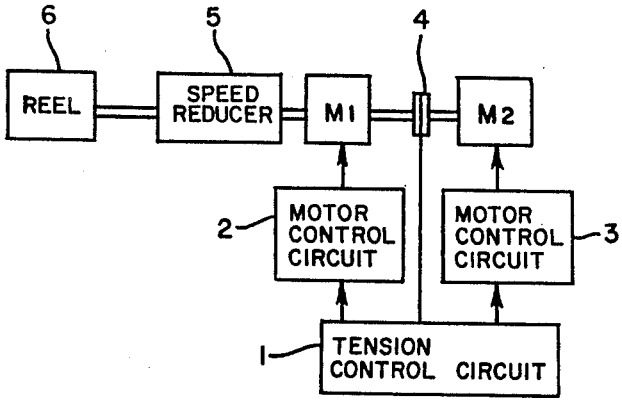
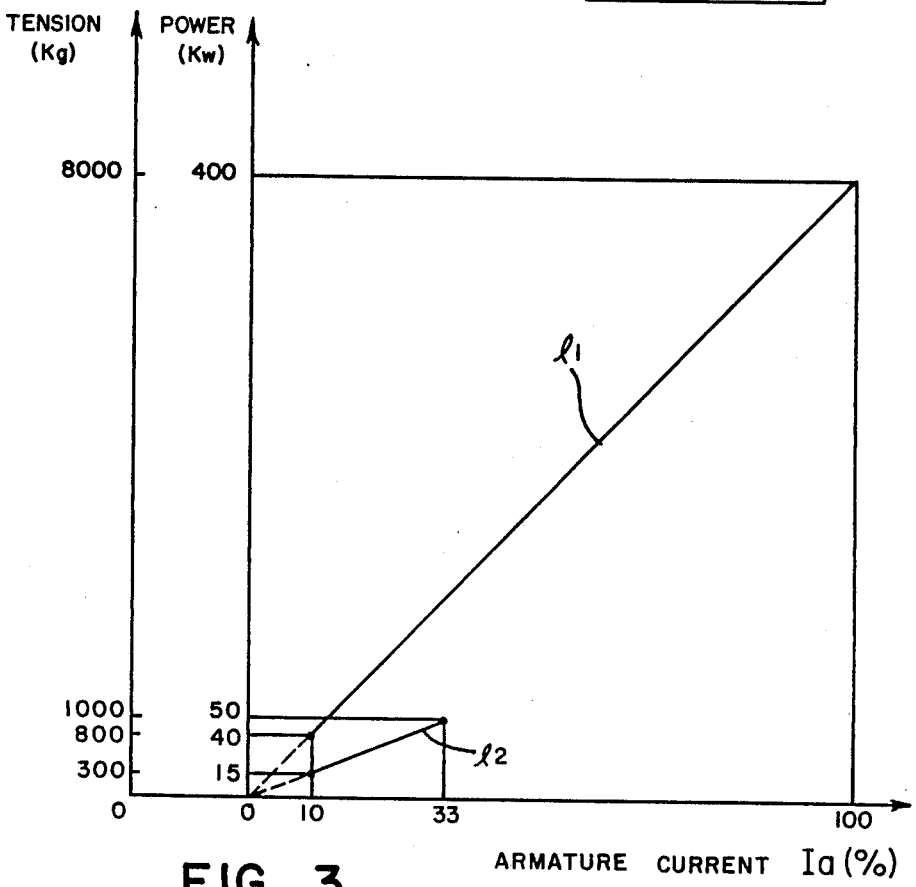
FIG. 3

METHOD AND APPARATUS FOR CONTROLLING REEL TENSION

This is a continuation of application Ser. No. 776,971 filed Sept. 12, 1985, now U.S. Pat. No. 4,720,661.

TECHNICAL FIELD

The present invention relates to method and apparatus for controlling a tension of a reel driving motor which is used to drive a reel for taking up or rewinding material in a rolling machine processing line, rubber or plastic manufacturing equipment, or the like and, more particularly, to method and apparatus for controlling a reel tension which is suitable for enlargement of a tension control range.

BACKGROUND ART

Hitherto, an apparatus for controlling the reel tension in the rolling machine processing line, rubber or plastic manufacturing equipment, or the like is constituted by a DC motor, an electric power converting apparatus and a field power source tension control circuit.

A tension control method of a reel driving motor using the DC motor will then be described hereinbelow. A generating torque $T_M$ of the DC motor and a necessary torque $T_M'$ upon take-up operation are respectively expressed by $$T_M = K_1 \cdot \phi \cdot I_a \quad (1)$$

$$T_M' = K_2 \cdot T \cdot D \quad (2)$$

where, $I_a$ is an armature current, $\phi$ is a field magnetic flux, T is a take-up tension, D is a diameter of a coil, and $K_l$ and $K_2$ are constants.

The relation among the take-up tension T, field magnetic flux $\phi$, coil diameter D, and armature current $I_a$ will be represented by $$T = \frac{K_1}{K_2} \cdot \frac{\phi}{D} \cdot I_a \quad (3)$$

assuming that equations (1) and (2) are equal. On the other hand, a counter electromotive voltage E of the DC motor is expressed by $$E = K_3 \cdot \phi \cdot N \quad (4)$$

where, N is a rotating speed of the motor and $K_3$ is a constant. In addition, the relation of $$v = \pi \cdot D \cdot N \quad (5)$$

is satisfied among a take-up speed v, coil diameter D and rotating speed N of the motor.

From equations (4) and (5), $$\frac{\phi}{D} = \frac{\pi}{K_3} \cdot \frac{E}{v} \quad (6)$$

is satisfied and from equations (3) and (6), $$T = K_3 \cdot \frac{E}{v} \cdot I_a \quad (7)$$

is satisfied.

It will be appreciated from equation (7) that the take-up tension T is proportional to the armature current $I_a$ by making the take-up speed v be proportional to the counter electromotive voltage E. Namely, the tension control in the reel driving motor using the DC motor is performed by controlling the armature current $I_a$ by making the take-up speed v be proportional to the counter electromotive voltage E.

Conventionally, various kinds of devices have been made to extend the tension control range; however, all of them fundamentally perform the tandem drive and an example of such a driving method is shown in FIG. 2. In this tandem drive, two motors $M_1$ and $M_2$ are connected through a clutch 4 and the motors $M_1$ and $M_2$ are controlled through motor control circuits 2 and 3 in response to a command from a tension control circuit 1, thereby controlling the reel tension. The two motors $M_1$ and $M_2$ are used in case of the high tension control, while the clutch 4 is released and the single motor $M_1$ is used in case of the low tension control, thereby controlling the tension of a reel 6.

A principle of enlargement of the tension control range due to such a tandem drive will now be described with respect to the cases where the two motors $M_1$ and $M_2$ have the same rating and where they have the different ratings.

(1) In the case where the ratings of the motors $M_1$ and $M_2$ are the same:

In case of rolling machines, a range of the armature current $I_a$ which can be accurately set and controlled is generally 1:10 to 1:15 at a current command level. When the setting and controlling range of the armature current $I_a$ is set to 1:10, the setting and controlling ranges of the armature current $I_a$ in the cases where the two motors $M_1$ and $M_2$ are coupled and where only the motor $M_1$ is used will be as follows if the sum of the rated armature currents when the motors $M_1$ and $M_2$ are coupled is 100%.

| | $I_{a\,max}$ | $I_{a\,min}$ |
|---|---|---|
| When the motors $M_1$ and $M_2$ are connected: | 100 (%) | 10 (%) |
| When only the motor $M_1$ is used: | 50 (%) | 5 (%) |

Therefore, the setting and controlling range of the armature current $I_a$ becomes

5(%) :100(%)=1:20

Thus, it is possible to derive the setting and controlling range of the armature current $I_a$ which is twice that in the case where one motor is used. (2) In the case where the rating of the motor $M_2$ is larger than that of the motor $M_1$:

Similarly to the foregoing case of (1), the setting and controlling range of the armature current $I_a$ is set to 1:10 and the capacity of the motor $M_1$ is set to be $\frac{1}{4}$ of the capacity of the motor $M_2$. The setting and controlling ranges of the armature current $I_a$ in the cases where the two motors $M_1$ and $M_2$ are coupled and where only the motor $M_1$ is used will be as follows if the sum of the rated armature currents when the motors $M_1$ and $M_2$ are coupled is 100%.

| | $I_{a\,max}$ | $I_{a\,min}$ |
|---|---|---|
| When the motors $M_1$ and $M_2$ are connected: | 100 (%) | 10 (%) |
| When only the motor $M_1$ is used: | 25 (%) | 2.5 (%) |

Therefore, the setting and controlling range of the armature current $I_a$ becomes $2.5(\%):100(\%) = 1:40$ Thus, it is possible to obtain the setting and controlling range of the armature current $I_a$ which is four times larger than that in the case where one motor is used.

DISCLOSURE OF INVENTION

However, those conventional technologies have the following drawbacks. Namely, in any of the foregoing cases (1) and (2), the output shaft of the motor $M_1$ has to endure (the rating of the motor $M_1$ + the rating of the motor $M_2$). Further, when two motors exist, two sets of motor control circuits are also needed, so that the equipment or the like becomes more expensive as compared with the case where one motor is used. In addition, even in terms of the mechanical loss and inertia of the reel driving system, the tandem drive is essentially disadvantageous as compared with the case where one motor is used.

It is an object of the present invention to solve the foregoing problems and to provide method and apparatus for controlling the reel tension in which the tension control of a wide range and with a high degree of accuracy can be performed.

It is presumed so far that the tension controlling range which can be controlled by a single DC motor is limited to up to about 1:10 and for the equipment which needs a tension controlling range exceeding this range, two or more DC motors are combined and used as mentioned above or the gear ratio between the reel and the DC motor is switched. For instance, the high tension range is covered by two motors and the low tension range is covered by disconnecting one of the two motors and by use of the remaining one motor.

It is the principle of the DC motor that the torque is reduced as the field system is weakened. Therefore, in the conventional equipment using two DC motors as well, even if a single DC motor having the capacity which is equal to the sum of the capacities of two motors is employed in place of two motors, the low torque could be generated by setting the field system at a low level in principle. However, DC motors have troublesome phenomenon called an armature reaction; therefore, the characteristic of the motor changes in association with a variation in armature current or the rectification deteriorates.

To avoid such inconveniences, in the conventional tension control, the apparatus is used within the field system setting range below about 1:4. Due to this, when a single DC motor is used, it is impossible to exceed the tension controlling range of about 1:10, that is determined by the controlling range of the armature current. Therefore, with regard to the reel which needs a tension controlling range over 1:10, a plurality of DC motors have been combined and used as a tension controlling motor for the reel for many years so far.

In the present invention, an attention is paid to the fact such that the undesirable phenomena such as the change of the characteristic, deterioration of the rectification or the like due to the armature reaction as mentioned above that is caused by setting the field system at a low level can be fairly suppressed by limiting the setting and controlling range of the armature current to a low region. The field system is set at a low level so that the ratio between the field magnetic flux and the coil diameter becomes lower than the maximum value, and at the same time the upper limit of the operating armature current which is practically applied is set to be low, thereby making it possible to perform the stable tension control within the low tension range which could not be realized so far by a single DC motor.

The first invention of a method of controlling a reel tension according to the present invention relates to a method of controlling a reel tension in a single reel driving apparatus in which the field system of at least one DC motor is controlled so that a ratio of a field magnetic flux to a diameter of a coil becomes constant and which consists of arbitrary number of DC motors including the foregoing DC motor and a electric power converting apparatus for driving this DC motor, wherein this method is characterized by comprising the steps of: selecting the ratio of the field magnetic flux to the coil diameter to become an arbitrary value step by step; limiting the maximum value of an operating armature current which is practically applied so as to become a value lower than a rated value in the case where the ratio of the field magnetic flux to the coil diameter is a value other than the maximum value; and controlling the field system so as to maintain the foregoing selected ratio of the field magnetic flux to the coil diameter. The field system control in the present invention includes two kinds of methods: a method whereby a signal which is proportional to the coil diameter is set to an objective value of the field magnetic flux, thereby controlling the field system; and a method whereby a signal which is proportional to the take-up speed is set to an objective value of the counter electromotive voltage, thereby controlling the field system. The former method is generally adopted.

An apparatus for controlling a reel tension which embodies the first invention comprises: a coil diameter arithmetic operation circuit to calculate a diameter of a coil from a take-up speed and a rotating speed of a motor; a constant setting device to set a ratio of a field magnetic flux to the coil diameter; a field current command circuit which obtains a magnetic flux command from the coil diameter obtained by the coil diameter arithmetic operation circuit and from the ratio of the field magnetic flux to the coil diameter selected by the constant setting device and thereafter converts this magnetic flux command to a field current and then outputs this field current as a field current command to a field power source apparatus; a correcting circuit to obtain an amount of inertia correction and an amount of mechanical loss correction from the coil diameter derived by the coil diameter arithmetic operation circuit and from the take-up speed and to add both of those correction amounts, and thereby to obtain a correcting quantity; a circuit to add a desired tension from a tension setting device and the correcting quantity obtained by the correcting circuit and to output this added value as an armature current command; and a limiter to limit the maximum value of the armature current command so as to become a value lower than a rated value in the case where the selected ratio of the field magnetic flux to the coil diameter is a value other than the maximum value.

The second invention of a method of controlling a reel tension according to the present invention relates to a method of controlling a reel tension in an apparatus for controlling the reel tension in which a field system of at least one DC motor is controlled so that a ratio of a field magnetic flux to a diameter of a coil becomes constant, and a single reel driving apparatus consisting of arbitrary number of DC motors including the foregoing DC motor and an electric power converting apparatus for driving this DC motor is controlled so as to keep a constant tension, wherein this method is characterized by comprising the steps of: selecting the ratio of the field magnetic flux to the coil diameter to become an arbitrary value step by step; limiting the maximum value of an operating armature current which is practically applied so as to become a value lower than a rated value in the case where the ratio of the field magnetic flux to the coil diameter is a value other than the maximum value; changing a converting ratio of an armature current command to the sum of a desired tension and a tension as much as a correcting quantity required to maintain the desired tension constant so as to be inversely proportional to the selected ratio of the field magnetic flux to the coil diameter; and controlling the field system so as to maintain the selected ratio of the field magnetic flux to the coil diameter.

Similarly to the first invention, in the field system control section in the second invention, there are two kinds of methods: a method whereby a signal which is proportional to the coil diameter is set to an objective value of the field magnetic flux, thereby controlling the field system; and a method whereby a signal which is proportional to the take-up speed is set to an objective value of the counter electromotive voltage, thereby controlling the field system.

An apparatus for controlling a reel tension which embodies the second invention comprises: a coil diameter arithmetic operation circuit to calculate a diameter of a coil from a take-up speed and a rotating speed of a motor; a constant setting device to set a ratio of a field magnetic flux to the coil diameter; a field current command circuit which obtains a magnetic flux command from the coil diameter obtained by the coil diameter arithmetic operation circuit and from the ratio of the field magnetic flux to the coil diameter selected by the constant setting device and thereafter converts this magnetic flux command to a field current and then outputs this field current as a field current command to a field power source apparatus; a correcting circuit to obtain an amount of inertia correction and an amount of mechanical loss correction from the coil diameter derived by the coil diameter arithmetic operation circuit and from the take-up speed and to add both of those correction amounts, and thereby to obtain a correcting quantity; an armature current command arithmetic operation circuit to add a desired tension from a tension setting device and the correcting quantity obtained by the correcting circuit and to make a converting ratio to an armature current command to the result of this addition be inversely proportional to the selected ratio of the field magnetic flux to the coild diameter, and to output the armature current command; and a limiter to limit the maximum value of the armature current command so as to become a value lower than a rated value in the case where the selected ratio of the filed magnetic flux to the coil diameter is a value other than the maximum value.

In the invention, the ratio of the field magnetic flux to the coil diameter of a single DC motor is not limited to the maximum value but may be selected to an arbitrary value step by step and also the maximum value of the operating armature current which is practically applied is limited, thereby enabling a wide tension controlling range exceeding the limit of 1:10 to 1-to be derived. In addition, there is no need to switch the gear ratio between the reel and the DC motor.

BRIEF DESCRIPTION OF DRAWINGS

FIG. 2 is a block diagram of a conventional reel tension control apparatus of the tandem drive type; and FIG. 3 is a diagram showing the rating and use range of a DC motor constituting a reel tension control apparatus of one embodiment of the present invention.

BEST MODE FOR CARRYING OUT THE INVENTION

Figure 1:
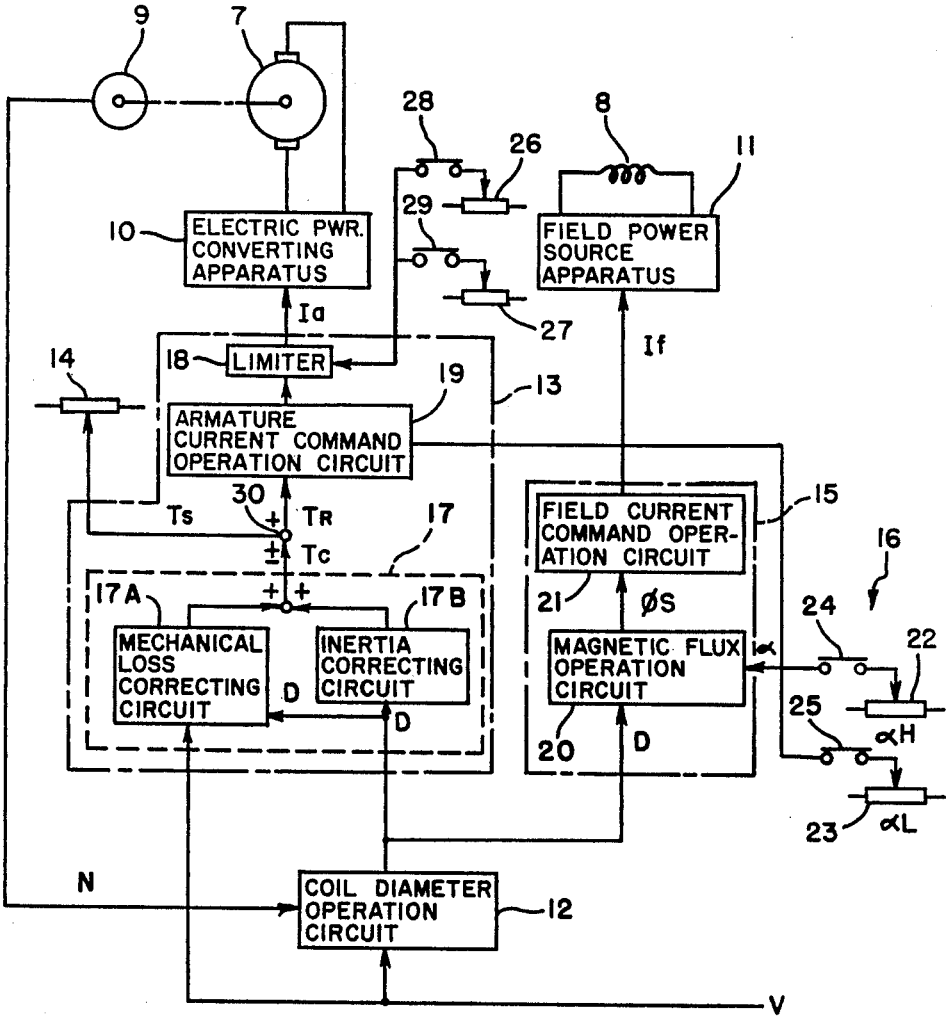
FIG. 1 is a block diagram of an apparatus for controlling a reel tension according to one embodiment of the present invention.

An embodiment of the present invention will now be described hereinbelow with reference to the drawings.

FIG. 3 is a graph showing the armature current $I_a$ in the tension control of the reel which is driven by a single DC motor and a desired dynamic power P or take-up tension T at the rated maximum take-up speed. This graph shows the relation between the armature current and the output range in the case where the ratio $\phi/D$ of the field magnetic flux $\phi$ to the coil diameter D is directly increased or decreased by two steps or where the above ratio $\phi/D$ is indirectly increased or decreased by two steps by changing the ratio E/v of the counter electromotive voltage E to the take-up speed v by two steps, and also in the case where the maximum value of the operating armature current which is practically applied is limited to be a value lower than the rated value upon operation in the mode in that the ratio $\phi/D$ of the field magnetic flux $\phi$ to the coil diameter D is lower than the maximum value. On the other hand, an axis of ordinate may be regarded as the tension T in place the power P since it represents the power P at the rated maximum take-up speed. In this case, it can be considered such that a straight line $l_1$ indicates a range for the high tension operation and a straight line $l_2$ represents a range for the low tension operation.

This point will then be described in detail hereinbelow with reference to the practical specifications of the equipment. First, the specifications of the rolling machine processing line are set such that the maximum value of the line speed, namely, the rated maximum take-up speed is v=300 (m/min), the coil diameter D=500 to 1300 (mm) and the take-up tension T=300 to 8000 (kg). Then, the capacity of the DC motor for the reel is obtained.

The maximum power $P_{max}$ of the motor is $$P_{max} = \frac{300(\text{m/min}) \times 8000(\text{kg})}{102 \times 60} = 392(Kw) \approx 400(Kw)$$

where, denominator $=102\times60$ is a constant.

A coil winding ratio $R_D$ is $$R_D = 1300\ (\text{mm})/500\ (\text{mm}) = 2.6$$

From equation (3) or (7), the field controlling range corresponding to the coil winding ratio $R_D$ is needed to maintain the ratio E/v of the counter electromotive voltage E to the take-up speed v or the ratio $\phi/D$ of the field magnetic flux $\phi$ to the coil diameter D constant, so that the base speed becomes 160/2.6 (rpm)=615 (rpm) when the maximum speed of the motor is 1600 (rpm). Due to this, the rating upon high tension operation of the DC motor for the reel is set to 400Kw 440v 615rpm/1600rpm in consideration of the mechanical loss as well.

Next, the rating of the DC motor for the reel upon low tension operation is derived. A minimum power $P_{min}$ of the DC motor is $$P_{min} = \frac{300(m/min) \times 300(kg)}{102 \times 60} = 14.7(Kw) \approx 15(Kw)$$

The rated voltage of the motor in case of the minimum power of 15 (Kw) is selected in a manner such that the rated armature current $I_a$ in case of the maximum power of 400 (Kw) and a field current $I_{fmax}$ in case of the rotating speed of 615 (rpm) become 100 (%) and the armature current $I_a$ in case of the minimum power of 15 (Kw) becomes 10 (%) of the lower limit of the setting and controlling range of the armature current. A field current $I_{fmin}$ in case of the maximum power of 400 (Kw) and the rotating speed of 1600 (rpm) is 100 (%)/2.6=38.5 since the coil winding ratio $R_D$=2.6. The power is proportional to the product of the voltage and armature current $I_a$, so that the voltage in case of the minimum power of 15 (Kw) becomes $$\frac{15(Kw) \times 440(v) \times 100(\%)}{400(Kw) \times 10(\%)} = 165(v)$$

In this case, the field currents $I_{fmax}$ (615 rpm) and $I_{fmin}$ (b 1600 rpm) can be obtained in a manner as follows.

$$T_M = K_1 \cdot \phi \cdot Ia = K_1' \cdot If \cdot Ia \quad (1)$$

$$P = K_5 \cdot N \cdot T_M \quad (8)$$

$$\frac{T_{M2}}{T_{M1}} = \frac{If_1 \cdot Ia_2}{If_2 \cdot Ia_1} = \frac{P_2}{P_1}$$

With regard to the case where $P_1$=400 (Kw) and $P_2$=15, when the values of the field current $I_f$ and armature current $I_a$ when N=615 (rpm) are substituted for the above-mentioned equation, $$\frac{10(\%) \times If_1}{100(\%) \times (100)\%} = \frac{15Kw}{400Kw}$$

$$\therefore If_1 = 37.5(\%)$$

$$\therefore If_2 = 37.5(\%) \times \frac{615(rpm)}{1600(rpm)} = 14.4(\%)$$

$$\frac{400(Kw)}{440(v)} / \frac{15(Kw)}{Z} = 100(\%)/10(\%)$$

$$Z = 165(v)$$

Next, in the operation in case of this voltage of 165 (V), it is necessary to limit the operating armature current which is practically applied in consideration of the armature reaction since the field current is small. In order to make a degree of influence of the armature current $I_a$ on the field magnetic flux equal to that upon operation at 440 (V), the operating armature current $I_a$ at the voltage of 165 (V) is obtained so that the maximum value of the $I_a/I_{fmin}$ in the operating range at the voltage of 165 (V) becomes equal to the maximum value of the $I_a/I_{fmin}$ in the operating range at 440 (V). The upper limit of the operating armature current $I_a$ is set to this value and the apparatus is used within this range, thereby suppressing the influence of the armature current $I_a$ on the field system to a degree which is equal to or lower than that upon operation at 440 (v). Namely, the armature current $I_a$ at the voltage of 165 (V) becomes $$\frac{100(\%) \times 14.4(\%)}{38.5(\%)} \approx 33(\%)$$

That is, the range of the armature current $I_a$ becomes 10(%) to 33(%) upon operation at the rated voltage of 165(V). In this case, the power of the DC motor becomes $$\frac{400(Kw) \times 165(v) \times 33(\%)}{400(v) \times 100(\%)} = 50(Kw)$$

This power becomes $$\frac{8000(Kg) \times 50(Kw)}{400(Kw)} = 1000(Kg)$$

in terms of tension.

The specifications of the motor determined due to the foregoing method are shown in Table 1.

TABLE 1

| POWER (Kw) | VOLTAGE (v) | ARMATURE CURRENT Ia (%) | FIELD CURRENT If (%) If max (615 rpm) | FIELD CURRENT If (%) If min (1600 rpm) | TENSION (Kg) |
|---|---|---|---|---|---|
| 400 | 440 | 100 | 100 | 38.5 | 8000 |
| 50 | 165 | 33 | 37.5 | 14.4 | 1000 |
| 15 | 165 | 10 | 37.5 | 14.4 | 300 |

$$\frac{400(Kw)}{440(v)} / \frac{P(Kw)}{165(v)} = 100(\%)/33(\%)$$

$\therefore P = 50(Kw)$

Practically speaking, the single DC motor for the reel shown as an example is used as the motor having the following two ratings although it is the single DC motor as the result of that the ratio $\phi/D$ of the field magnetic flux $\phi$ to the coil diameter D is directly or indirectly increased or decreased by two steps. Namely, 400Kw 440V 615(RPM)/1600(rpm)
50Kw 165V 615(rpm)/1600(rpm)

FIG. 3 shows the rated power of the DC motor for the reel and the use range of the tension obtained as described above, in which the straight line $l_1$ indicates the use range (8000–1000 kg) upon high tension operation in the case where the rated output is 400 (Kw), while the straight line $l_2$ represents the use range (1000–300 kg) upon low tension operation in the case where the rated power is 50 (Kw). As compared with the fact such that the use range in the conventional low tension control is limited by only the straight line $l_1$, it will be understood that the further low output range (namely, low tension range) can be utilized by a single motor according to the present invention.

FIG. 1 is a block diagram showing an embodiment of an apparatus for controlling a reel tension regarding to the second invention. A reason why the diagram of the embodiment regarding the first inveniton is omitted is because parts of component requirements are added to the first invention to constitute the second invention and the description of the embodiment of the second invention can be also used as the explanation of the embodiment of the first embodiment.

The apparatus for controlling the reel tension of FIG. 1 relates to the constant tension control in which the reel equipment is driven by the DC motor and the ratio of the field magnetic flux $\phi$ to the coil diameter D is held to be constant with regard to the take-up or rewinding operation by the reel and is concerned with the example whereby one DC motor is used as a motor having two ratings by changing a ratio $\alpha$ of the objective value of the field magnetic flux $\phi$ to the coil diameter D in accordance with the setting range of the tension.

The reel tension control apparatus according to this embodiment comprises: a DC motor 7; a field system 8; a speed detector 9; an electric power converting apparatus 10; a field power source apparatus 11; a coil diameter arithmetic operating circuit 12; an armature current command circuit 13; a tension setting device 14; a field current command circuit 15; a constant setting device 16 (setting devices 22 and 23) for setting the ratio $\alpha$ of the field magnetic flux to the coil diameter; contacts 24 and 25 for selecting the constant setting device 16; and an adder 30. The coil diameter arithmetic operation circuit 12 calculates the coil diameter D on the basis of equation (5).

The armature current command circuit 13 comprises: a tension correcting circuit 17; an armature current command arithmetic operation circuit 19; a limiter 18 for suppressing the maximum value of the armature current command to be lower than the rated value in the case where the selected ratio of the field magnetic flux to the coil diameter is a value other than the maximum value; constant setting devices 26 and 27; and contacts 28 and 29.

The tension correcting circuit 17 comprises a mechanical loss correcting circuit 17A and an inertia correcting circuit 17B.

A signal $T_c$ of which outputs of those two correcting circuits 17A and 17B were added is a correction signal necessary to generate a desired tension (namely, set tension) $T_s$. An addition signal $T_R$ of the signals $T_c$ and $T_s$ due to the adder 30 is inputted to the armature current command circuit 19. The signal of which the addition signal $T_R$ was divided by the output signal $\alpha$ of the constant setting device 16 is outputted and this signal $I_a$ is supplied as a command value of the armature current to the electric power converting apparatus 10 through the limiter 18. A part of the power converting apparatus 10 which receives the armature current command $I_a$ is provided with a current control loop (not shown). Due to this, the voltage which is applied to the DC motor 7 is adjusted by controlling, for instance, a firing angle of a thyristor, so that the armature current of the DC motor 7 is controlled so as to become the command value. The field current command circuit 15 consists of a magnetic flux arithmetic operation circuit 20 and a field current command arithmetic operation circuit 21. The coil diameter signal D which is inputted to the magnetic flux operation circuit 20 is multiplied by the output signal $\alpha$ of the constant setting device 16, so that a magnetic flux command $\phi_s$ is outputted. This magnetic flux command $\phi_s$ is converted to a field current $I_f$ by the field current command operation circuit 21 and is inputted as the command value of the field current to the field power source apparatus 11. The field power source apparatus 11 is provided with a current control loop (not shown), thereby adjusting the voltage which is applied to the field system 8 by controlling, for example, a firing angle of a thyristor, so that the field current $I_f$ is controlled to become the command value.

According to the conventional technology, the field current $I_a$ is determined such that the field magnetic flux $\phi$ becomes the maximum field magnetic flux $\phi_{Dmax}$ when the coil diameter D is the maximum value $D_{max}$. Thereafter, the ratio $\phi/D$ of the field magnetic flux $\phi$ to the coil diameter D is fixed and kept to the value of $\phi_{Dmax}/D_{max}$ irrespective of the set tension.

In the embodiment according to the second invention, the ratio $\phi/D=\alpha$ is switched to two large and small values such as $\alpha=100(\%)$ and $\alpha=37.5$ (%). This embodiment will then be described in detail hereinbelow.

When the high tension mode is selected by an operation mode selecting switch (not shown) in the constant setting device 16, the contact 24 is closed. On the contrary, when the low tension mode is selected, the contact 25 is closed.

When the coil diameter D is maximum, the constant setting device 22 for the high tension mode sets the field magnetic flux $\phi$ to 100% (namely, the field current is 100%). (Table 1). On the other hand, when the coil diameter D is maximum, the constant setting device 23 for the low tension mode sets the field magnetic flux to 37.5% (i.e., the field current is 37.5%). (Table 1)

FIG. 3 shows the foregoing relation, in which an axis of abscissa indicates the armature current $I_a$ (%) and an axis of ordinate represents the power P(Kw) which is required for the motor 7 when the take-up speed v (which equals line speed) is constant (v =300 m/min in this embodiment) and also denotes the tension T (kg). The numeral data in Table 1 is shown as a graph. The straight line $l_1$ is the straight line in the high tension mode and represents the relation between the armature current $I_a$ the tension T or power P when the constant setting device 22 is selected.

The straight line $l_2$ is the straight line in the low tension mode and indicates the relation between the armature current $I_a$ and the tension T or power P when the constant setting device 23 is selected.

To generate the same tension for a single set tension level in any of the high tension mode $l_1$ and low tension mode $l_2$, the ratio $I_a/T$ of the armature current $I_a$ which is needed to generate the desired tension T has to be contrarily set to $1/\alpha$ times since the ratio $\phi/D$ is increased by $\alpha$ times. This is because the output signal of the constant setting device 16 is inputted to the armature current command operation circuit 19.

Generally, the range where the armature current can be accurately set and controlled is 1:10 to 1:15 in terms of the current command level. FIG. 3 shows the relation between the straight lines $l_1$ and $l_2$ when the minimum value of the armature current $I_a$ due to such a limitation is set to 10(%). FIG. 3 denotes that the tension setting range of 1 : 27 (=1:8000/300) can be derived by switching the straight line $l_1$ representing the tension setting range (1:10) due to the conventional technology to the straight line $l_2$.

On the other hand, in the embodiment of FIG. 1, the method whereby the field system control is performed by setting the signal which is proportional to the coil diameter D to the objective value of the field magnetic flux $\phi$ has been mentioned; however, there is also another method whereby the field system control is performed by setting the signal which is proportional to the take-up speed v to the objective value of the counter electromotive voltage. The latter method relates to the tension control whereby the reel equipment is driven by the DC motor and the signal which is proportional to the take-up speed v is set to the objective value of the counter electromotive voltage during the take-up or rewinding operation by the reel and the detected counter electromotive voltage is compared with this objective value and the field current is controlled such that the difference between them becomes zero. In this method, a single DC motor is used as a motor having multi-rating by switching the ratio of the counter electromotive voltage to the take-up speed in accordance with the tension setting range. In the former method, the constant setting device 16 in FIG. 1 sets the ratio of the field magnetic flux $\phi$ to the coil diameter D; on the other hand, in the latter method, the constant setting device sets the ratio of the counter electromotive voltage to the take-up speed. There is not an essential difference between both methods except the above-mentioned point; therefore, the drawing of the embodiment is omitted.

We claim:

1. A method for controlling the reel tension of a reel driving apparatus by a plurality of DC motors each having a field system and an armature in which the field system of at least one of said plurality of said DC motors is controlled so that the ratio of the field magnetic flux to the coil diameter of the reel becomes constant, the armature current of said one DC motor being controlled by an electric power converting equipment, and said reel driving apparatus being controlled so as to keep a constant reel tension, the method comprising the steps of:

selecting the ratio of the field magnetic flux to the coil diameter from a group consisting of a maximum setting value, and at least one other setting value below said maximum setting value;

limiting maximum value of the operating armature current, when said selected ratio of the field magnetic flux to the coil diameter is less than said maximum setting value, to a value lower than the sum of the armature current, below rated current, and the inertia compensation current corresponding to the rate of change of the take-up speed; and controlling the field system so as to maintain said selected ratio of the field magnetic flux to the coil diameter.

2. A method according to claim 1, wherein a signal which is proportional to the coil diameter is set to a desired value of the field magnetic flux, thereby controlling the field system.

3. A method according to claim 1, wherein a signal which is proportional to the take-up speed is set to a desired value of a counter-electromotive voltage, thereby controlling the field system.

4. A method according to claim 1, wherein the converting ratio of an armature current command signal to the sum of a desired tension and a tension as great as a compensating quantity required to keep said desired tension constant, is changed so as to be inversely proportional to said selected ratio of the field magnetic flux to the coil diameter.

5. A method according to claim 4, wherein a signal which is proportional to the coil diameter is set to a desired value of the field magnetic flux, thereby controlling the field system.

6. A method according to claim 4, wherein a signal which is proportional to the take-up speed is set to a desired value of a counter-electromotive voltage, thereby controlling the field system.

7. An apparatus for controlling the reel tension of a reel driving apparatus driven by a DC motor having a field system and an armature in which the field system of said DC motor is controlled so that the ratio of the field magnetic flux to the coil diameter of the reel becomes constant, the armature current of said DC motor being controlled by an electric power converting equipment, and said reel driving apparatus being controlled so as to keep a constant reel tension, the apparatus comprising:

a coil diameter arithmetic operation circuit to calculate the coil diameter from the take-up speed and the rotating speed of the motor;

a constant setting device to select the ratio of the field magnetic flux to the coil diameter from a group consisting of a maximum setting value, and at least one other setting value below said maximum setting value ;

a field current command circuit which obtains a magnetic flux command from the coil diameter, derived from said coil diameter arithmetic operation circuit l, and from the ratio of the field magnetic flux to the coil diameter which was selected by said constant setting device , and thereafter converts said magnetic flux command to a field current and then outputs said field current to a field power source apparatus as a field current command;

a tension compensating circuit to obtain an amount of inertia compensation and an amount of mechanical loss compensation from the coil diameter, derived from said coil diameter arithmetic operation circuit, and from the take-up speed, and to obtain a tension compensation quantity by summing both of said compensation amounts;

an armature current command arithmetic operation circuit to add a desired tension from a tension setting device and said tension compensation quantity, and to output said added value as an armature current command; and , limiter means responsive to said armature current command arithmetic opertion circuit to limit the maximum value of the operating armature current, when said selected ratio of the field magnetic flux to the coil diameter is less than said maximum setting value, to a value lower than the sum of the armature current, below rated current, and the inertia compensation current corresponding to the rate of change of the take-up speed.

8. An apparatus according to claim 7, wherein a signal which is proportional to the coil diameter is set to a desired value of the field magnetic flux, thereby controlling the field system.

9. An apparatus according to claim 7, wherein a signal which is proportional to the take-up speed is set to a desired value of a counter-electromotive voltage, thereby controlling the field system.

10. An apparatus according to claim 7, wherein the armature current command arithmetic operation circuit makes a conversion ratio of the armature current to the result of said added value inversely proportional to said selected ratio of the field magnetic flux to the coil diameter, and thereby outputting the armature current command.

11. An apparatus according to claim 10, wherein a signal which is proportional to the coil diameter is set to a desired value of the field magnetic flux, thereby controlling the field system.

12. An apparatus according to claim 10, wherein a signal which is proportional to the take-up speed is set to a desired value of a counter-electromotive voltage, thereby controlling the field system.

13. An apparatus for controlling the reel tension of a reel driving apparatus driven by a plurality of DC motors each having a field system and an armature in which the field system of at least one of said DC motors is controlled so that the ratio of the field magnetic flux to the coil diameter of the reel becomes constant, the armature current of said one DC motor being controlled by an electric power converting equipment, and said reel driving apparatus being controlled so as to keep a constant reel tension, the apparatus comprising:

a coil diameter arithmetic operation circuit to calculate the coil diameter from the take-up speed and the rotating speed of the DC motor;

a constant setting device to select the ratio of the field magnetic flux to the coil diameter from a group consisting of a maximum setting value, and at least one other setting value below said maximum setting value;

a field current command circuit which obtains a magnetic flux command from the coil diameter , derived from said coil diameter arithmetic operation circuit , and from the ratio of the field magnetic flux to the coil diameter which was selected by said constant setting device , and thereafter converts said magnetic flux command to a field current and then outputs said field current to a field power source apparatus as a field current command;

a tension compensating circuit to obtain an amount of inertia compensation and an amount of mechanical loss compensation from the coil diameter , derived from said coil diameter arithmetic operation circuit, and from the take-up speed, and to obtain a tension compensation quantity by summing both of said compensation amounts;

an armature current command arithmetic operation circuit to add a desired tension from a tension setting device and said tension compensation quantity, and to output said added value as an armature current command; and , limiter means responsive to said armature current command arithmetic operation circuit to limit the maximum value of the operating armature current, when said selected ratio of the field magnetic flux to the coil diameter is less than said maximum setting value, to a value lower than the sum of the armature current, below rated current, and the inertia compensation current corresponding to the rate of change of the take-up speed.

14. An apparatus according to claim 13, wherein a signal which is proportional to the coil diameter is set to a desired value of the field magnetic flux, thereby controlling the field system.

15. An apparatus according to claim 13, wherein a signal which is proportional to the take-up speed is set to a desired value of a counter-electromotive voltage, thereby controlling the field system.

16. An apparatus according to claim 13, wherein the armature current command arithmetic operation circuit makes a conversion ratio of the armature current to the result of said added value inversely proportional to said selected ratio of the field magnetic flux to the coil diameter, and thereby outputting the armature current command.

17. An apparatus according to claim 16, wherein a signal which is proportional to the coil diameter is set to a desired value of the field magnetic flux, thereby controlling the field system.

18. An apparatus according to claim 16, wherein a signal which is proportional to the take-up speed is set to a desired value of a counter-electromotive voltage, thereby controlling the field system.

* * * * *